United States Patent [19]

Kawashima et al.

[11] 4,058,264

[45] Nov. 15, 1977

[54] YARN WOUND PACKAGE PROVIDED WITH A TRANSFER TAIL WIND AND METHOD FOR FORMING THE TRANSFER TAIL WIND

[75] Inventors: Kohei Kawashima; Keiji Ikeno; Hajime Nakanishi, all of Matsuyama, Japan

[73] Assignee: Teijin Limited, Osaka, Japan

[21] Appl. No.: 596,213

[22] Filed: July 16, 1975

[51] Int. Cl.[2] ..... B65H 55/04; B65H 54/34; D01H 1/38

[52] U.S. Cl. ..... 242/18 PW; 57/34 TT; 242/18 EW; 242/165

[58] Field of Search ..... 57/34 TT, 156; 242/18 EW, 18 PW, 165, 159, 164, 174

[56] References Cited

U.S. PATENT DOCUMENTS

| | | | |
|---|---|---|---|
| 2,800,290 | 7/1957 | Hess | 242/165 |
| 3,043,528 | 7/1962 | Siegenthaler | 242/18 EW |
| 3,075,715 | 1/1963 | Hensen et al. | 242/18 PW |
| 3,095,683 | 7/1963 | Tessmer | 57/34 TT |
| 3,110,450 | 11/1963 | Raasch | 242/165 X |
| 3,263,409 | 8/1966 | Zuidema | 57/34 TT X |
| 3,283,489 | 11/1966 | Bakker | 57/34 TT |
| 3,669,373 | 6/1972 | Hori et al. | 242/18 EW |
| 3,841,074 | 10/1974 | Wachendorf et al. | 57/34 TT |
| 3,858,816 | 1/1975 | Corbiere | 242/18 PW |

FOREIGN PATENT DOCUMENTS

| | | | |
|---|---|---|---|
| 1,188,991 | 3/1965 | Germany | 242/18 EW |
| 876,212 | 8/1961 | United Kingdom | 242/165 |

*Primary Examiner*—John Petrakes
*Attorney, Agent, or Firm*—Burgess, Ryan and Wayne

[57] ABSTRACT

A yarn wound package formed on a bobbin by a supplied yarn comprising a normal yarn wound portion and a transfer tail wind portion formed on the bobbin at an end portion thereof adjacent to the normal yarn wound portion. The transfer tail wind portion is composed of a plurality of spiral windings wound on the bobbin and a plurality of said spiral windings wound on a bobbin portion adjacent to an end thereof are formed in superimposed condition at at least one portion on the bobbin. An end of the transfer tail wind extending from the above-mentioned superimposed portion is cut. A yarn guide means is pivotally mounted on a member holding the bobbin so as to positively introduce the supplied yarn to the above-mentioned particular portion of the bobbin so as to superimpose the spiral windings when the transfer tail wind is forming.

2 Claims, 10 Drawing Figures

YARN WOUND PACKAGE PROVIDED WITH A TRANSFER TAIL WIND AND METHOD FOR FORMING THE TRANSFER TAIL WIND

DETAILED EXPLANATION OF THE INVENTION

The present invention relates to a yarn package wound on a yarn twisting and/or winding device of a twistng machine such as a ring twister, a draw twister, and a twister for manufacturing a textured yarn, and on a horizontal winding machine, such as a cheese or cone winder and a method and apparatus for winding a partially overlapped transfer tail wind. Especially, such yarn package is provided with a transfer tail wind on a tail end portion of a bare bobbin, where the end of the transfer tail yarn is cut out so that transfer tail wind is separated from waste spool coils. Further, the transfer tail wind is followed by a first layer of yarn wound on the bare bobbin.

There are many types of packages which are provided with a transfer tail wind. The purpose of providing such transfer tail is that an end of a transfer tail of one package is to be knotted with an end of a leading yarn of another package, when two or more packages are simultaneously creeled on a creel drive, so that a connected yarn wound on said packages can be unwound from them continuously. When said knotting operation of two yarn ends is carried out, it is necessary that the manual drawing of a transfer tail from a package can be carried out easily, and further such a trouble due to the breakage of a single filament within the yarn, or the separation of a single filament from the main body of the yarn should be eliminated. To assure such withdrawing of a transfer tail from a package, it is preferable to hold or support the end of said transfer tail on the bare bobbin until said package is ready to be creeled on said creel device. Such support of the end of said transfer tail on the bare bobbin is usually provided on a bobbin when said package is doffed from a twisting device or winding device, by temporalily gluing a tape on said bare bobbin so that it can cover said transfer tail wind. If there is no provision of such tape when said package is transported from the twisting device onto the creel, the transfer tail wind is sometimes loosened on the bare surface of the bobbin when the package is vibrated or undergoes a shock. Sometimes said loosened transfer tail becomes an entangled transfer tail and, thus, the withdrawing of a straightened transfer tail from the package becomes very difficult. Therefore, a tape for supporting the transfer tail is widely used. However there are some drawbacks connected with the use of glued tape on the transfer tail wind. One of these is that the tape must be arranged at a most effective position on the bare bobbin, where the end of the transfer tail can be held on the bare bobbin firmly, so as to avoid loosening of the transfer tail wind. Such most effective position on a bobbin must be found by the operator. Consequently, it is quite difficult to replace these manual operations by mechanical means. Another drawback is that when creeling a package on the creel device, said tape must be manually stripped from the bare bobbin. This stripping of the tape sometimes causes the drawback that the surface of the strand of yarn becomes roughened due to separation of some of the filaments from the yarn, because these separated filaments are glued on the surface of the tape.

On the other hand, there is another concept to bind the transfer tail wind on the bare bobbin mechanically. That is, the waste spool device having a flange portion is mounted on a spindle at the bottom of a bare bobbin mounted on the spindle. This flange portion is provided with an upwardly facing conical surface inclined from edge portion thereof to the spindle, a transfer tail wind arranged in parallel on the conical surface slides on the surface of the cone and finally the transfer tail wind is converted into a stacked coil of yarn formed about the bobbin in wholly overlapped condition.

Another concept is to provide an overlapped transfer tail wind by temporarily stopping the yarn traverse, while said yarn traverse arranges said wind on the bare bobbin in the arrangement of a parallel wind. In this case, said temporary stopping of the yarn traverse is carried out for a yarn intermediate between the yarn coils on the waste spool and the yarn coils on the bare bobbin.

A further concept is that, by winding a transfer tail wind in the arrangement of ribbon wind, one coil is overlapped on another coil.

In these cases, the transfer tail wind wound a bare bobbin is overlapped along the entire portion of each winding thereof. Therefore, if the overlapped wind consists of too many coils, the withdrawing of said transfer tail from the package becomes difficult, and sometimes a single filament is damaged or is separated from the surface of the yarn. Contrary to this, if said overlapped wind consists of too few coils the merit to use this overlapped wind is too small. Consequently, the proper number of overlaps must be determined such winding of a given number of overlaps is more difficult when the yarn winding speed becomes high, i.e., the spindle is turned at high speed.

The object of the present invention is to eliminate the above mentioned drawbacks accompanying the known transfer tail wind, even when the yarn winding speed is very high.

The transfer tail wind of the present invention consists of several windings of normal coils and several windings of partially overlapped coils provided with a tail of the yarn extending from the overlapped portion. The end of the tail of the yarn is cut, so that the end is separated from the windings on the waste spool.

Another object of the present invention is to provide a winding method and apparatus to form the above-mentioned transfer tail wind by means of a quite simple mechanism which is provided on the spindle or the waste spool mounted on the spindle, and the withdrawing of the transfer tail can be carried out with ease by the operator. Furthermore, when the yarn package is to be doffed from the spindle, the only manual operation required is the cutting of the yarn to separate the transfer tail wind from the coils on the waste spool.

Because the partially superimposed wind can be wound mechanically, no additional operation by the operator is necessary after the package is doffed from the spindle, and the winding of the partially superimposed windings of the transfer tail wind can be steadily carried out even when the winding speed is very high.

The invention will be better understood from the following description with reference to the accompanying drawings in which:

FIGS. 9 and 10 are perspective views of a further two embodiments of the apparatus of the present invention, wherein FIG. 9 is an embodiment of a waste spool provided with a yarn guide member, and FIG. 10 is another embodiment of an additional ring provided with a yarn guide member which is mounted on a spindle and arranged above the waste spool.

Figure 1:
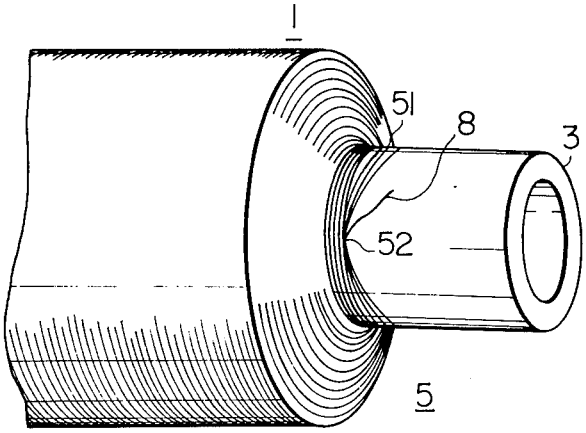
FIG. 1 is an enlarged perspective view of the bottom part of the package of the present invention.
Figure 2:
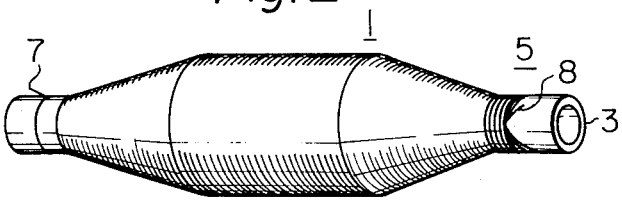
FIG. 2 is a perspective view of the bobbin of the present invention.
Figure 3:
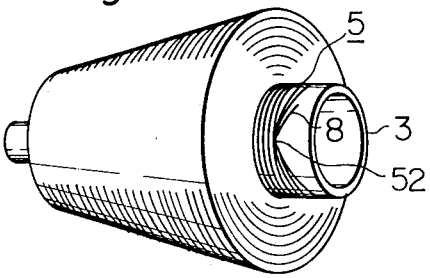
FIG. 3 is a perspective view of the cone of the present invention.

As shown in FIGS. 1, 2 and 3, a yarn package is formed on a bobbin or tube 3. At the bottom region of this bobbin 3 and onto the bare surface of the bobbin 3, a transfer tail wind 5 is wound. The transfer tail wind 5 consists of spiral windings wherein a plurality of these windings are partly superimposed at a portion 52 and an end 8 of the transfer tail wind 5 extending from the superimposed portion 52 of the first winding of yarn. The above-mentioned partly superimposed portion 52 is hereinafter referred to a superimposed portion 52. The end 8 is cut by a cutting device, so that the end 8 can be separated from the end of the yarn windings wound on the waste spool as mentioned hereinafter. As can be seen from FIG. 1, in an initial stage of forming the transfer tail wind, a plurality of windings are concentrated to a portion of the bobbin in such a manner that these windings are stacked in a plane perpendicular to the axis of the bobbin 3.

As the package 1 of the present invention is provided with a transfer tail wind 5, and the transfer tail wind 5 is provided with partially overlapped portion 52, as mentioned above, when the end 8 of the transfer tail wind 5 is pulled manually along the axis of the bobbin, the held condition of the portion 52 of the first winding by the portion of the second winding can be easily released, and there is no entanglement between adjacent single filaments within the yarn. Therefore, there are no problems or drawbacks such as the occurrance of a damaged filament, or the separation of a filament from the surface of a yarn when the transfer tail wind 5 is drawn from the package 1. This means that during the transportation of a package 1 of the present invention there is no releasing of yarn from the yarn coils on the surface of the bobbin 3.

It is preferable that the superimposed portion 52 of the transfer tail wind 5 be as long as up to one-forth of one turn length of each windings. A length less than one-eighth of one turn length will realize the best result. Less than three overlapped portions within one winding is suitable, while generally one superimposed portion within one winding is preferable. Two to ten windings with superimposed portions is suitable, while 3 or 4 windings with superimposed portions is preferable. The denier of the yarn to be wound on a package 1 of the present invention must be less than 350 denier, and yarn less than 250 denier is preferable, because this prevents free slipdown of the superimposed portion of the transfer tail wind.

Figure 4:
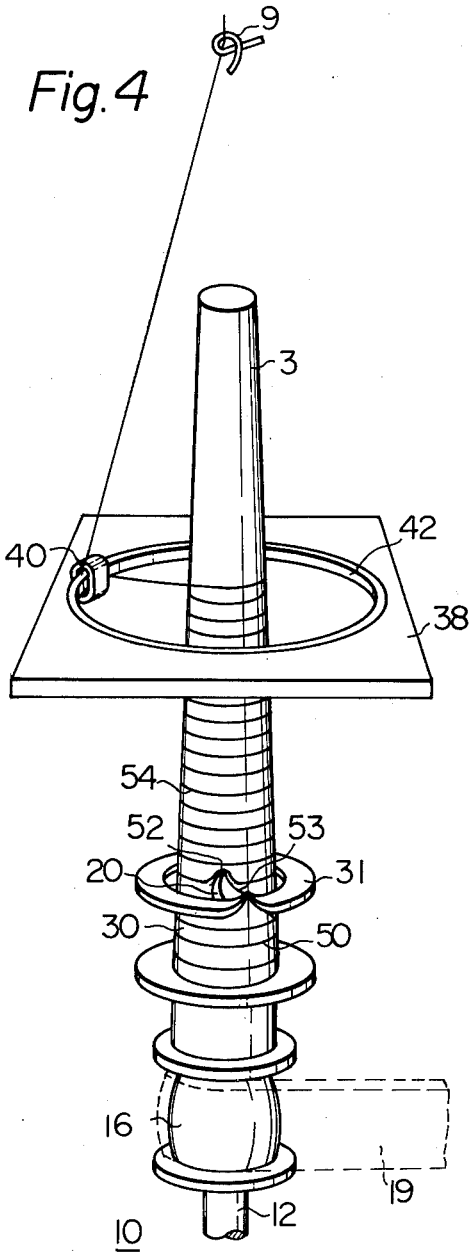
FIG. 4 is an explanatory perspective view of the twisting and winding device of the present invention used for a draw-twister.
Figure 6:
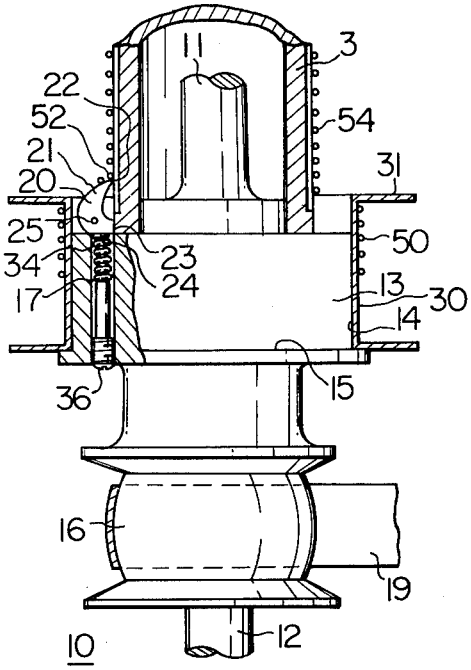
FIG. 6 is the sectional view of one embodiment of the apparatus of the present invention.
Figure 7:
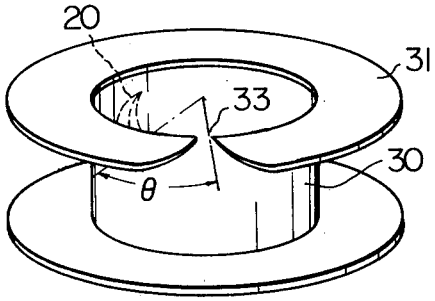
FIG. 7 is the perspective view showing a waste spool and a yarn member of the present invention used for the embodiment as shown in FIG. 6.

In FIG. 4, a twisting and winding unit of a draw-twister is shown and in FIG. 6 one embodiment of the present invention is shown. Referring to FIGS. 4 and 6 the spindle 10 comprises a top part 11, a waste spool holding part 13, a wharve 16 and a spindle blade 12, which is supported by a bearing device not shown, such as a bolster (not shown). Onto the top of the spindle 10, a bobbin or tube 3 is mounted, so that the bobbin 3 can be rotated around its axis by the frictional driving of a driving tape 19 via the spindle wharve 16. Among the upper portion of the wharve 16 and the under portion of the bobbin 3 mounted on the spindle 10, a waste spool holding part 13 with a cylindrical configuration is provided. The waste spool holding part 13 has a cylindrical surface 14 and a flange 15. Onto the cylindrical surface 14 of the part 13, a waste spool 30 is mounted which also rests on the stepped surface of the flange 15. A cut-out 33 (as shown in FIG. 7) is provided on the upper flange 31 of the waste spool 30. As shown in FIG. 4 a ring holder 38 provided with a ring 42 is arranged coaxially with the spindle 10 and can be moved vertically along the axis of the spindle 10. Consequently a yarn twisted by the spindle 10 can be directed toward the axis of the spindle and wrapped onto the surface of the waste spool 30 or the bobbin 3 after the yarn is guided by a traveller 40, which is slidably mounted on the ring 42. The height of the ring holder 38 from the waste spool 30 defines the position of the yarn turn wound on the bobbin 3 or on the waste spool 30.

Figure 5:
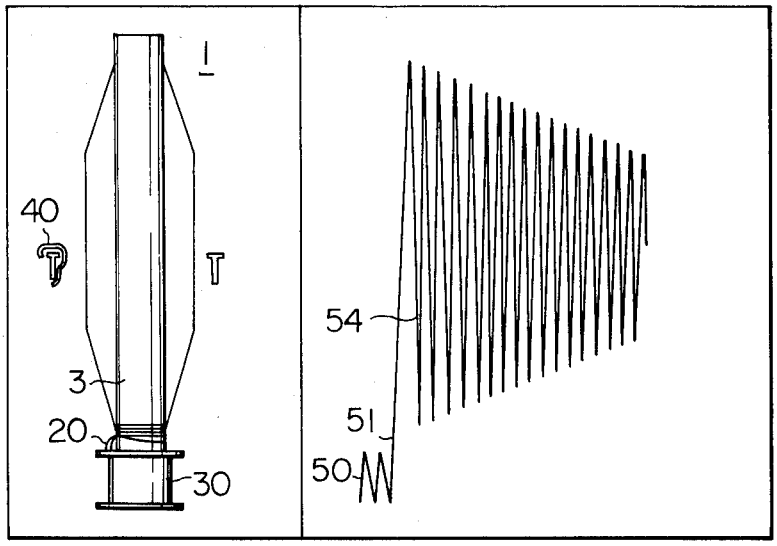
FIG. 5 is the diagram showing the traverse sequence of the windings of the wound yarn from the winds on the waste spool to the first yarn layer on the bare bobbin.

As shown in FIG. 5, the amount of up and down movement of said ring holder 38 is varied as shown by a zig-zag line. That is, when the winding of the yarn is commenced, coils are firstly wound on the waste spool 30 as the coils 50, followed by the normal coils 54 onto the surface of the bobbin 3, said two coils 50 and 54 being connected by the coil 51.

As shown in FIG. 6 a guide member 20 provided with a yarn guide convex surface 21 at its upper part, and also a vertical surface 23 and a horizontal surface 24 at its lower part, is pivotally mounted on the waste spool holding part 13 by means of a pin 25. Just below the horizontal surface 24 of the guide member 20, a vertical hole 17 is formed in the waste spool holding part 13. Within the hole 17, a spring 34 is housed so that the top end face of the spring 34 is in contact with the surface 24, while the bottom end face of the spring 34 is supported by the upper end face of an adjusting screw 36, which is screwed into a threaded portion of the bottom of the vertical hole 17. Consequently, the spring force pushing the surface 24 acts to turn the guide member 20 about the pin 25 toward the counter-clockwise direction in FIG. 6, when the bobbin 3 is not installed on the spindle 10. When said bobbin 3 is completely mounted on the spindle 10, the bottom edge of the bobbin 3 comes into contact with the surface 23 of the guide member 20 and, therefore, the movement of the bobbin 3 causes the guide member 20 to turn toward the clockwise direction against the spring force of the spring 34. An edge 22 of the curved yarn guide surface 21 of the guide member 20 approaches the surface of the bobbin 3, to such an extent that a yarn to be wound on the bare bobbin cannot pass through the gap between the edge 22 and the outside surface of the bobbin 3. Consequently, when the winding of the parallel wind of the yarn is going on as shown in FIG. 5, the windings 50 are initially wound on the waste spool 30 and, then, the windings are followed by the coils 54, while the connecting yarn 53 (as shown in FIG. 4) extending between two windings passes through the cut-out 33 of the upper flange 31 of the waste spool 30. As the yarn windings are wound in parallel, i.e., two adjacent windings of yarn are wound closely side by side, the windings of the yarn portion 51 can be placed on the curved surface 21 of the guide member 20. This means that said yarn can be guided toward the edge 22 of the guide member 20 along said curved surface 21, and finally the yarn can rest on the surface of the bobbin 3 at a position next to the edge 22. When the second winding is wound, the yarn of the second winding is also placed on the curved surface 21, and it lies on the yarn of the first winding after sliding on the curved surface 21 of said guide member 20.

Such stacking of the yarns is realized along the curved surface 21 near the edge 22. Thus, the superimposed transfer tail portion 52 as shown in FIGS. 1 and 4 can be formed. By designing the length and the curvature of the curved surface 21 properly, the required number of yarns can be stacked in the superimposed portion 52.

When the package 1 is doffed from the spindle 10, the operator or automatic doffing and donning machine cuts out the yarn 53 (shown in FIG. 4) by using a cutting means, such as a scissors or a heat cutting device, so that the transfer tail wind 5 can be completely separated from the yarn windings 50 on the waste spool 30. Therefore, when the package 1 is manually or mechanically lifted upwardly along the axis of the spindle 10, there is no force which acts against the end 8 of the transfer tail. As a result, the superimposed portion 52 of the transfer tail wind 5 is in its original wound condition. Thus, by using the apparatus as shown in FIGS. 4 and 6, the package 1 as shown in FIGS. 1 and 2 can be wound according to the yarn guiding method as mentioned above.

Figure 8:
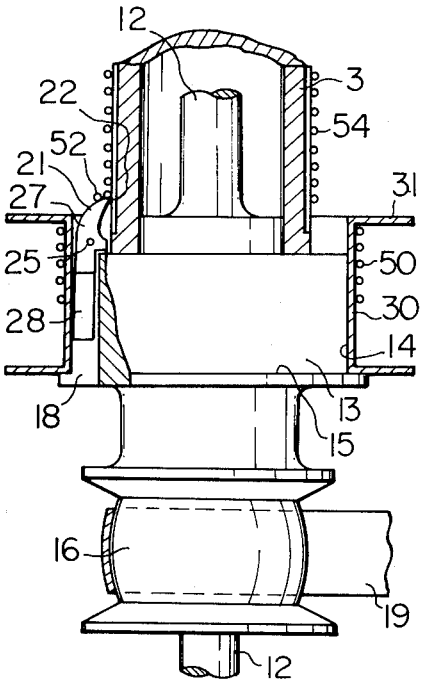
FIG. 8 is a sectional view of another embodiment of the apparatus of the present invention.

Similar results can be attained by using the embodiment shown in FIG. 8. In this embodiment the guide member 20 is replaced by the guide member 27. Instead of surfaces 23 and 24 the guide member 27 has a downwardly extended arm provided with an additional weight 28. In addition, the vertical hole 17 in the waste spool holding part 13 of the spindle 10 is replaced by a cut-out recess 18 which houses the additional dead weight 28. In this embodiment, when the spindle 10 is not turned the edge 22 rests at the position where there is a small gap between said edge 22 and the outer surface of the bobbin 3. The winding method by means of this embodiment is exactly same as with the embodiment as shown in FIG. 6.

As shown in FIG. 7, the positions of the cut-out 33 of the upper flange 31 of the waste spool 30, and the guide member 20 or 27 (shown in FIG. 6 or 8), are preferably so arranged that, in the driving condition, the guide member is angularly offset from the position of the cut-out at an angle $\theta$, which is in a range of from 10° to 45°.

Figure 9:
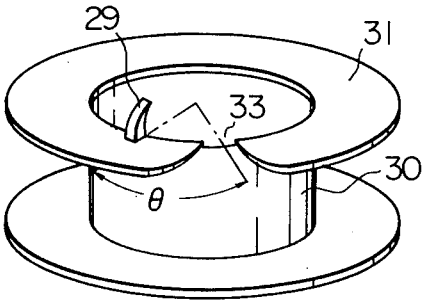
Figure 10:
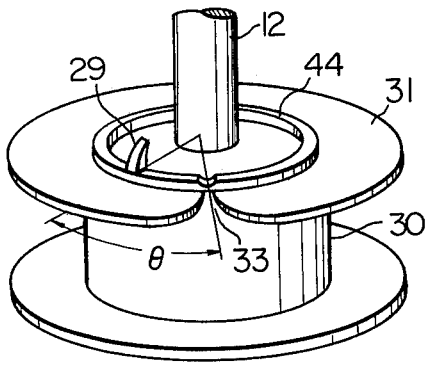

When a yarn to be wound on the bobbin 3 is very coarse or the winding yarn tension is quite small, the embodiments as shown in FIGS. 6 through 8 can be replaced by the third embodiments shown in FIGS. 9 and 10. These latter embodiments are of quite single construction compared to that of the former two embodiments. Namely one guide member 29 is fixedly mounted on an upper flange 31 of the waste spool 30. Such guide member 29 is also provided with the curved convex surface 21 and the edge 22 similar to that on the guide member 20 or 27. Because the edge 22 is fixed and said edge approaches the surface of the bobbin 3 to such an extend that a gap is smaller than the diameter of yarn, the coarse yarn can not pass therethrough. If desired, such guide member 29 can be arranged on an additional ring 44 as shown in FIG. 10, which is mounted on the spindle and arranged just above the waste spool 30. In this embodiment, when the waste spool 30 is fully occupied with the waste yarn, the additional ring 44 is held at the bottom portion of the spindle and the waste spool 30 can be only taken from the spindle.

Some of the specifications of a practical example were as follows.

1. $\theta = 35°$
2. The height of guide member projected above the upper surface of the flange of the waste spool was 2.5mm, and the width of said guide member 24 was 3mm.
3. The RPM of the spindle was 10,000.
4. The denier of the yarn wound on the bobbin was 150, and the running speed of said yarn was 1000 m/min.
5. The diameter of bobbin was 51mm.
6. The traverse speed of the ring holder was 3.5 meters per minute.
7. The length of the overlapped transfer tail wind was 15mm, and the number of yarns stacked or overlapped was 4 yarns.

All of the packages wound on the apparatus as mentioned above could be rewound quite smoothly, even after they were transported packaged in polyethelene bags and packed in a carton box. That is, no loose transfer tail winds were found on any of the packages, and the drawing operation of the transfer tail from the package could be carried out smoothly. This means that quite a large labour savings can be attained by using the method and apparatus of the present invention when winding a package.

What is claimed is:

1. A winding method for forming a yarn package from a supplied yarn on a cylindrical bobbin comprising a normal winding portion and a transfer tail wind portion provided with a plurality of windings spirally formed on said bobbin at an end portion thereof adjacent to said normal winding portion, comprising positively leading a major length of said supplied yarn about a spiral path substantially perpendicular to the axis of said bobbin to form a helical winding, axially displacing a minor portion of at least one turn of said supplied yarn toward said normal winding portion, along a substantially V-shaped path to and from a particular portion of said end portion of said bobbin at an initial stage of forming said transfer tail winding portion and subsequent to said initial stage, and without disturbing said helical winding, winding at least one additional turn of said supplied yarn along a spiral path intersecting said particular portion of said end portion of said bobbin, at least two of said sprial windings of said transfer tail wind portion wound on said portion adjacent to an end of said bobbin being formed in superimposed condition at said particular portion of said bobbin, and overlapping said particular portion over a circumferential distance not exceeding one-eighth the circumference of said bobbin.

2. A yarn package formed by the method of claim 1.

* * * * *

UNITED STATES PATENT OFFICE
CERTIFICATE OF CORRECTION

Patent No. 4,058,264 Dated November 15, 1977

Inventor(s) Kohei Kawashima, et al

It is certified that error appears in the above-identified patent and that said Letters Patent are hereby corrected as shown below:

In the Title Page: The priority data is missing and should be noted as follows: -- Japanese patent application No. 84645/74, filed July 25, 1974 --.

Column 1, line 42: "temporalily" should be --temporarily--.

Column 2, line 23: After "wound" insert --around--.

line 32: After "determined" insert -- . --; replace "such" by --Such--.

Column 3, line 13: After "yarn" insert --guide--.

line 33: After "to" insert --as--.

line 51: "occurrance" should be --occurrence--.

UNITED STATES PATENT OFFICE

CERTIFICATE OF CORRECTION

Patent No. 4,058,264 Dated November 15, 1977

Inventor(s) Kohei Kawashima, et al

It is certified that error appears in the above-identified patent and that said Letters Patent are hereby corrected as shown below:

Column 4, line 37: Replace "as" by --and--.

Column 6, line 5: "extend" should be --extent--.

Signed and Sealed this

Second Day of May 1978

[SEAL]

Attest:

RUTH C. MASON
Attesting Officer

LUTRELLE F. PARKER
Acting Commissioner of Patents and Trademarks